US005979142A

United States Patent [19]

Kraft et al.

[11] Patent Number: 5,979,142

[45] Date of Patent: Nov. 9, 1999

[54] STRAW ATTACHING APPARATUS

[75] Inventors: Eberhard Kraft, Neckarbischofsheim, Germany; Hans-Peter Wild, Zug, Switzerland

[73] Assignee: Indag Gesellschaft fur Industriebedarf m.b.H., Heidelberg, Germany

[21] Appl. No.: 09/162,203

[22] Filed: Sep. 28, 1998

[30] Foreign Application Priority Data

Oct. 16, 1997 [DE] Germany ..... 197 45 855

[51] Int. Cl.[6] ..... B65B 61/00

[52] U.S. Cl. ..... 53/410; 53/168; 53/133.1; 53/133.2; 53/136.1

[58] Field of Search ..... 53/133.1, 133.2, 53/136.1, 154, 155, 168, 202, 237, 238, 239, 410, 445, 474

[56] References Cited

U.S. PATENT DOCUMENTS

| | | | |
|---|---|---|---|
| 3,144,976 | 8/1964 | Freshour . | |
| 3,812,572 | 5/1974 | Weikert | 53/133.2 X |
| 3,851,441 | 12/1974 | Marchand | 53/239 X |
| 3,968,901 | 7/1976 | Peva, Jr. . | |
| 4,293,369 | 10/1981 | Dilot et al. | 53/522 X |
| 4,362,075 | 12/1982 | Utsumi | 83/42 |
| 4,372,797 | 2/1983 | Dilot et al. | 53/410 X |
| 4,384,915 | 5/1983 | Utsumi | 493/383 X |
| 4,535,584 | 8/1985 | Tsubota | 53/136.1 |
| 4,572,758 | 2/1986 | Wild | 53/410 X |
| 4,574,558 | 3/1986 | Utsumi | 53/136.1 |
| 4,584,046 | 4/1986 | Geyssel | 156/358 |
| 4,584,819 | 4/1986 | Hakansson | 53/410 |
| 4,589,947 | 5/1986 | Tsuda | 53/133.1 X |
| 4,641,481 | 2/1987 | Brosten | 53/133.1 X |
| 4,669,699 | 6/1987 | Kaneko | 53/133.1 X |
| 4,707,965 | 11/1987 | Becker | 53/410 |
| 4,903,458 | 2/1990 | Hakansson | 53/133.1 X |
| 4,969,308 | 11/1990 | Hakansson | 53/133.1 X |
| 5,037,366 | 8/1991 | Yokoyama | 53/410 X |
| 5,375,391 | 12/1994 | Persson et al. | 53/133.1 |

FOREIGN PATENT DOCUMENTS

| | | |
|---|---|---|
| 0121056A1 | 10/1984 | European Pat. Off. . |
| 0149076A2 | 7/1985 | European Pat. Off. . |
| 0085895B1 | 1/1987 | European Pat. Off. . |
| 3401214 C2 | 8/1987 | Germany . |

*Primary Examiner*—Daniel B. Moon
*Attorney, Agent, or Firm*—Tilton, Fallon, Lungmus & Chestnut

[57] ABSTRACT

A straw attaching apparatus for attaching straws to beverage-filled sheet bags, the apparatus comprising a transportation means for transporting the beverage-filled sheet bags, a supply means for supplying a straw stripe to the beverage-filled sheet bags, and a pressing means for respectively pressing a straw to a beverage-filled sheet bag, and a corresponding method. A second supply means is provided for supplying a second straw stripe, with a control unit matching the speeds and operational sequences of the transportation means of the first and second supply means such that the first supply means attaches straws to the first, third, fifth . . . sheet bag supplied, and the second supply means attaches straws to the second, fourth, sixth . . . sheet bag supplied.

17 Claims, 4 Drawing Sheets

STRAW ATTACHING APPARATUS

FIELD OF THE INVENTION

The present invention relates to a straw attaching apparatus for attaching straws to beverage-filled sheet bags, and to a method of attaching straws to beverage-filled sheet bags.

BACKGROUND OF THE INVENTION

When in an automatic beverage filling system a straw is to be attached to the filled sheet bags at the end of the process, the straw being usable for withdrawing the beverage, a straw attaching apparatus is used for such a purpose. To this end, a generic apparatus comprises a transportation means with the help of which the beverage-filled sheet bags are transported to the straw attaching point. The straws are fed in the form of a continuous stripe to the beverage-filled bags. The straws of such a stripe are normally oriented in a direction perpendicular to the direction of transportation and are connected to a tape. Before the straw is attached to the beverage-filled sheet bags, the tape is severed or detached. A pressing means presses the isolated straws to the beverage-filled sheet bags. The straw is e.g. held by an adhesive on the beverage-filled bag, the adhesive having been applied to the bag beforehand. The individual straws may be enclosed in protective covers.

In the known apparatuses, the output is limited by the maximum speed at which the individual mechanical components can be operated without any deteriorating effect on reliability. Attention must here be paid to the fact that the positioning accuracy decreases at an increasing speed. In case of failure of a straw attaching apparatus, e.g. in the case of a crack in the straw stripe, the whole system must be stopped, or there will be faulty products.

SUMMARY OF THE INVENTION

It is the object of the present invention to provide a straw attaching apparatus and a corresponding method the throughput of which is increased without any deteriorating effect on reliability.

According to the invention the straw attaching apparatus comprises a second supply means for supplying a second straw stripe to the beverage-filled sheet bags, the second supply means comprising a second cutting means for severing the second straw stripe between two respective straws, and a second pressing means for respectively pressing a straw to a beverage-filled sheet bag. Furthermore, the straw attaching apparatus of the invention comprises a control unit which matches the speeds and operational sequences of the transportation means for the beverage-filled sheet bags and of the first and second supply means for supplying the straw stripes in such a manner that straws are attached by the first supply means to the first, third, fifth sheet bag supplied and by the second supply means to the second, fourth, sixth . . . sheet bag supplied. Thus the beverage-filled sheet bags are alternately provided with straws.

The second supply means which is mechanically independent of the first supply means supplies a separate straw stripe to the transportation path of the beverage-filled sheet bags. This can e.g. be performed by a system of deflection rolls and guide rollers. This straw stripe is severed by a cutting means, for instance by a knife, shortly before the point of attachment. Instead of the knife, however, it is also possible to use other cutting means, such as water-jet or laser cutters. The control unit controls the speed of the straw stripe in such a manner that every second beverage-filled sheet bag is provided by the second pressing device with a straw, whilst every first beverage-filled sheet bag is provided by the first supply means with a straw. Throughput can thereby be increased significantly without the need for increasing the speed of the individual mechanical components of the straw supply means. It is only the speed of the transportation means for supplying the beverage-filled sheet bags that must be increased, which is however no critical aspect. Due to the fact that the individual supply means are independently fed with a respective straw stripe, it is ensured that the load on the individual straw stripe is not excessively increased; otherwise, the risk of tearing or damage would be increased. In case of failure of one of the supply means the straw attaching operation can nevertheless be continued provided that a decrease in throughput is accepted.

In a further advantageous development, a third supply means is provided for supplying a third straw stripe to the beverage-filled sheet bags, the third supply means comprising a third cutting means for severing the third straw stripe, and a third pressing means. A third supply means can be used for further increasing the throughput in that each individual one of the three supply means only provides every third sheet bag with a straw.

However, a third supply means can be advantageously used in such a manner that it will only become operative when the first or second supply means fails. A uniform throughput of sheet bags is thereby ensured.

The third supply means can be activated as soon as the first or second supply means fails. Advantageously, there is provided a means for checking the function of the first and second supply means, the means supplying a signal to the control unit whenever a beverage-filled sheet bag has passed through the first two supply means without having been provided with a straw. The control unit will then give a command to the third supply means so that this means will provide the corresponding sheet bag with a straw at the right time. Such sensors can, e.g., be optical elements which measure the reflection of the beverage-filled sheet bag. Other designs are, however, not ruled out in practice.

According to a particularly simple design, the pressing means of the supply means are fingers that are pivotable about an axis and press the respective straws with their axially remote end onto the beverage-filled bags. The straw stripes can respectively be supplied via a roller of their own to the respective pressing means. The straws can be attached as uniformly as possible to the sheet bags in cases where at least two pressing means are provided per supply means, the pressing means engaging the straws at different heights.

The straw stripes may be stripes to which the straws are attached individually, but for hygienic reasons preference is given to straws inserted in protective covers.

To feed the straw stripes safely to the beverage-filled bags, the supply means can comprise clamp means which run along with the respective straw and have clamps which seize the straws. These clamps are activated by the control unit to release the straws when they are pressed by the pressing means onto the beverage-filled sheet bags. Such clamp means can be continuous endless belts with corresponding clamps which are released by a mechanism. Likewise, a rail guide for corresponding clamps is possible and a release means with the help of electrical signals.

Adhesion of the straws to the beverage-filled sheet bags is normally achieved with the help of an adhesive. Such an adhesive can be applied to the beverage-filled sheet bags in advance, so that the straws must only be pressed against this adhesive. Advantageously, however, the straws are already provided with corresponding points of adhesion and are supplied to the respective supply means with a cover tape which covers the adhesion points. Each supply means will then comprise a tape withdrawal means which removes the respective cover tape from the respective straw before the tape is severed by the respective cutting device. It is thereby ensured that the adhesion points are exposed just shortly before the gluing action.

When the straws are supplied to the beverage-filled sheet bags by a roller from which they are removed with the help of the pressing means, it is advantageous when this roller comprises means for guiding the individual straws. Such means may e.g. be recesses on the circumference of this roller, the recesses being adapted to the exterior profile of the straws or the straws inside the protective covers. Such a roller ensures a precise transportation of the straws. A further improvement is possible when devices are provided for holding the straws in the corresponding means of the roller. In such a case the roller may be surrounded in an area of its circumference by a further guide means in the manner of a railing, so that the straws cannot leave the means for guiding the individual straws on the roller. In a simple design the roller, however, may have suction means which retain the straws.

The straws can be combined into a straw stripe with the help of a transportation tape. In the case of straws which are positioned in a protective cover, the corresponding protective covers may be designed such that they are connected at the edges to a respectively adjacent protective cover for a straw, whereby a stripe is formed. It is here particularly advantageous when this stripe is reinforced by the cover tape for the adhesion points, so that the tape acts as a carrier tape.

BRIEF DESCRIPTION OF THE DRAWINGS

A special embodiment of a straw attaching apparatus of the invention shall now be explained with reference to the attached figures, of which.

DETAILED DESCRIPTION OF THE PREFERRED EMBODIMENT

Figure 1:
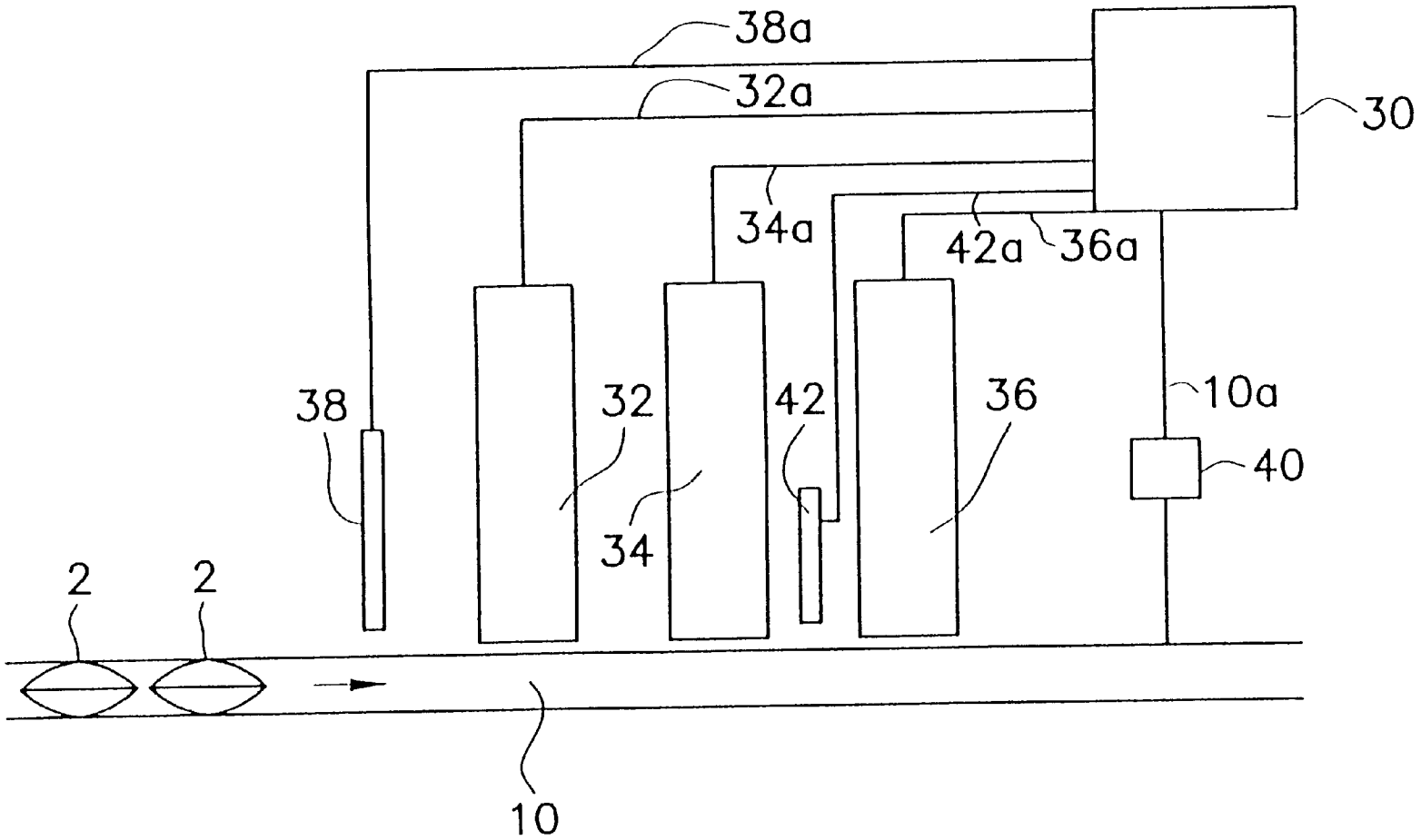
FIG. 1 is a strongly schematized general view showing how the individual components of an inventive straw attaching apparatus are arranged.
Figure 2:
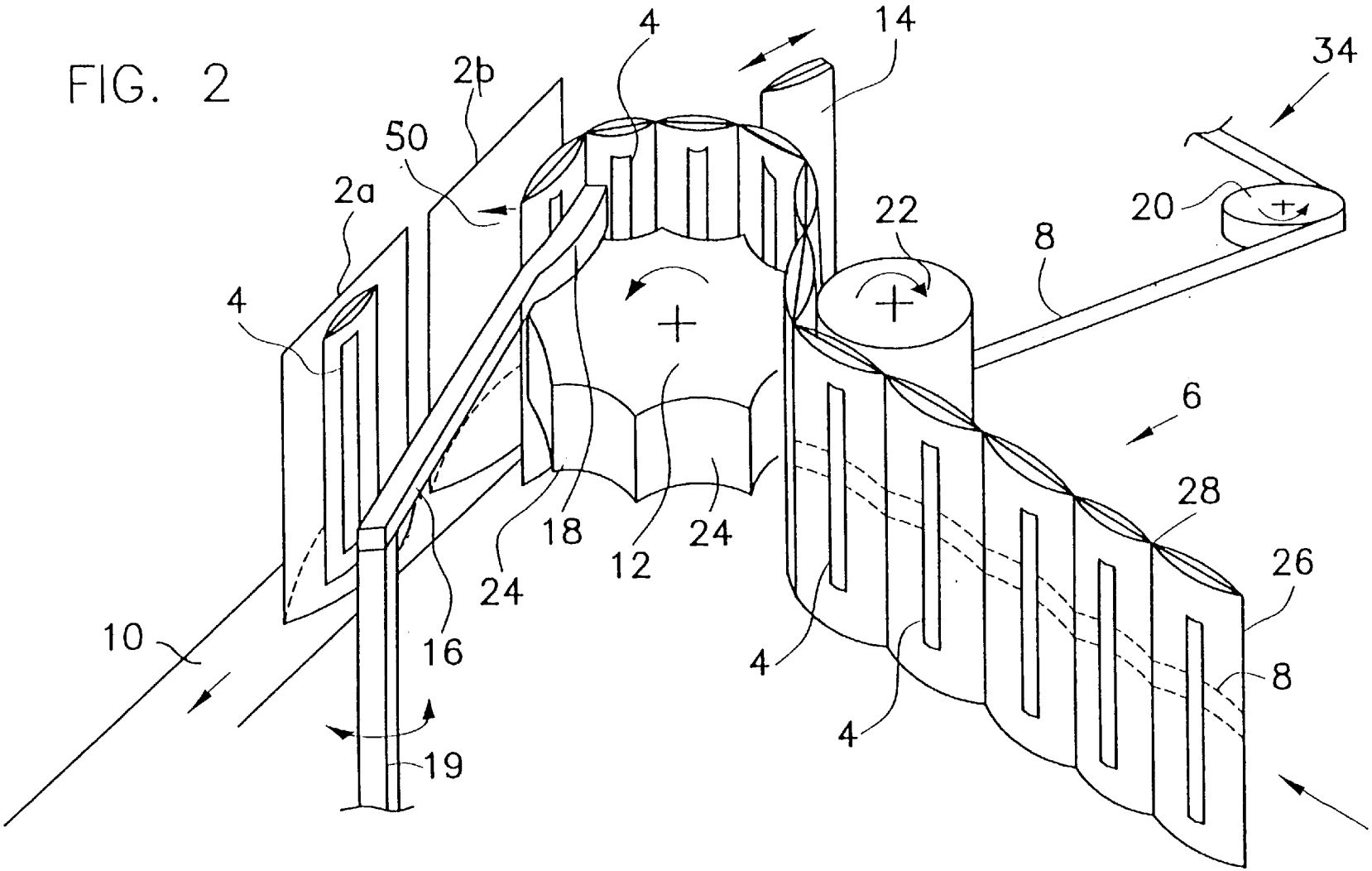
FIG. 2 is a perspective view showing an individual feeding device of a straw attaching apparatus of the invention.
Figure 3:
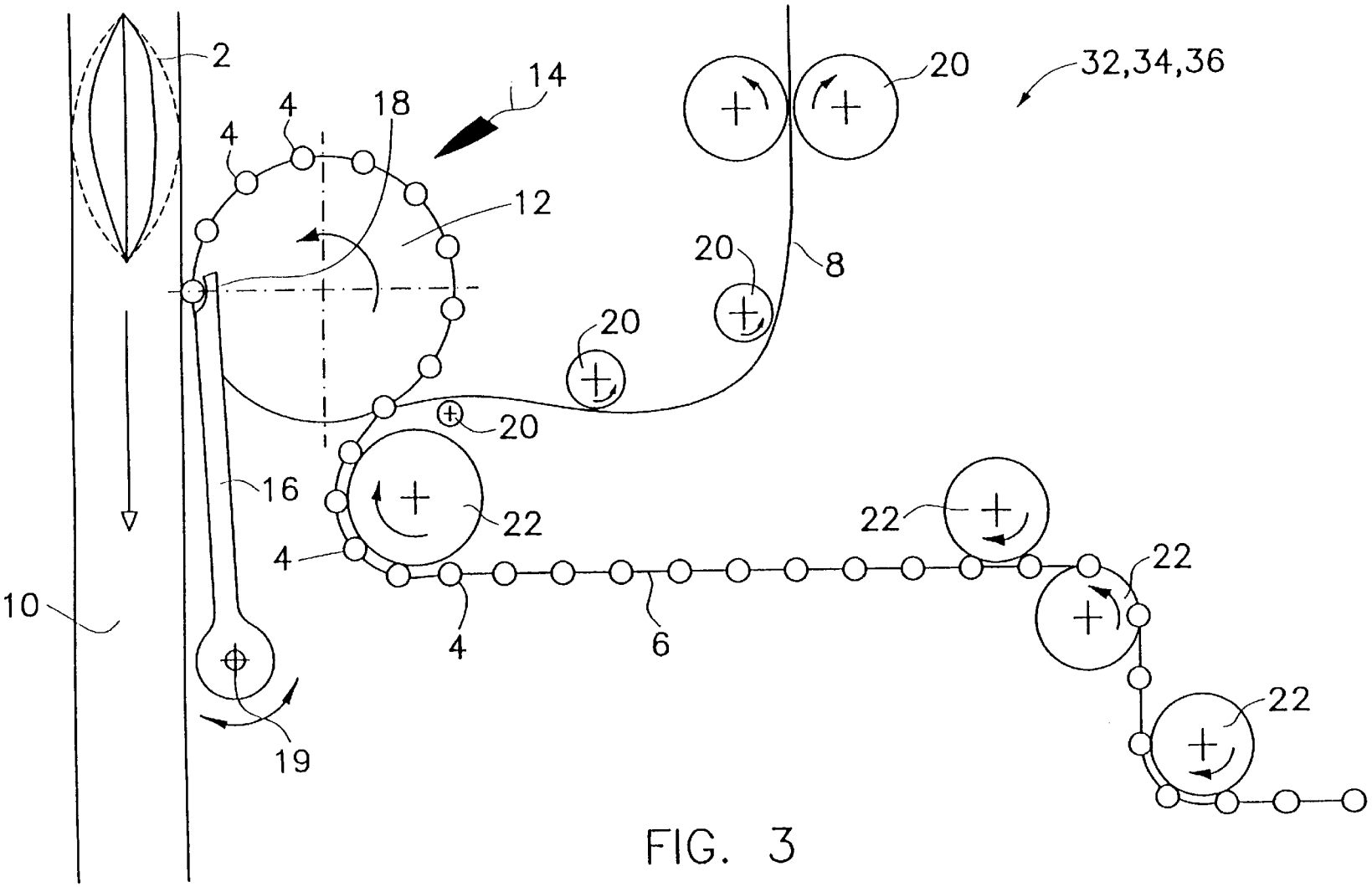
FIG. 3 is a schematized top view on the portion shown in FIG. 2.

FIG. 1 shows the basic structure of an inventive straw attaching apparatus in an exemplary manner. Sheet bags 2 are positioned on the transportation belt 10 which moves in the direction of the arrow. A sensor 38, for instance a light barrier or another optical or acoustic (ultrasonic) element, serves to sense the incoming sheet bags 2. Reference numerals 32 and 34 designate supply means for straw stripes, which in detail are shown in FIGS. 2 and 3 and will be explained later. Reference numeral 42 designates a function checking device which in this example is an optical sensor which checks whether a straw is attached to a sheet bag transported past the sensor. Downstream of said device 42, there is provided a third supply means 36 which has the same structure as the first and second supply means. Both the detecting sensor 38 and the optical sensor for function checking 42 are connected via signal lines 38*a* and 42*a*, respectively, to a control unit 30. A further signal line 10*a* connects the control unit 30 to the drive 40 for the transportation belt 10. The control unit 30 comprises, for instance, a microprocessor or a process computer, while the drive 40 may be an electric motor which is activated by the process computer 30 via signal line 10*a*. The process computer communicates with the first, second and third supply means via signal lines 32*a*, 34*a*, and 36*a* and controls the drives of the mechanical components contained therein, which will be explained in more detail with reference to FIGS. 2 and 3.

FIG. 2 is a perspective view showing the pressing portion of the second supply means 34. FIG. 3 shows the same portion in a schematized top view to illustrate the path taken by the individual straws 4. Identical elements as in FIG. 1 are designated by indentical reference numerals. The structure of the first and third supply means 32, 36 is the same, except that the respectively other beverage sheet bags 2*a* are optionally provided with straws 4.

Figure 4:
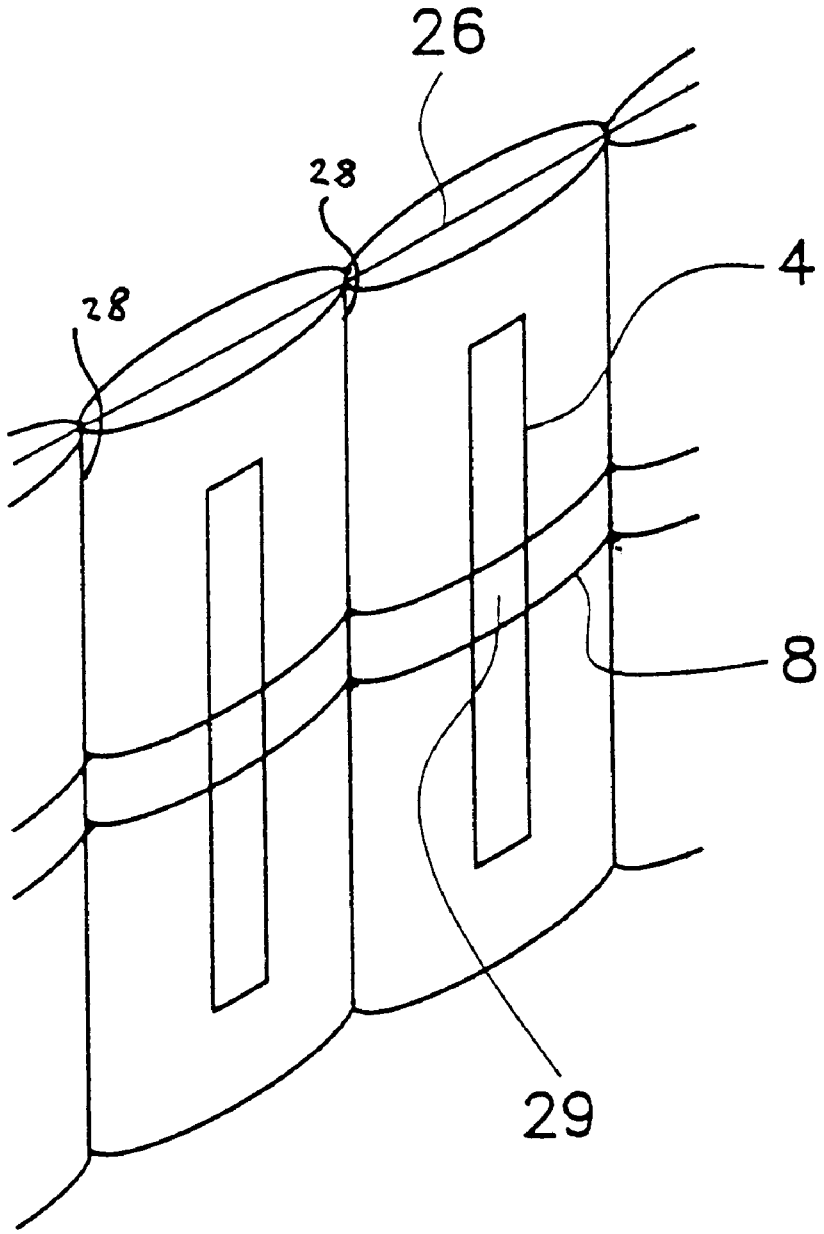
FIG. 4 shows a section of a straw stripe in viewing direction 1 of FIG. 2.

In the illustrated embodiment the straw stripe 6 consists of straws 4 which are encased in a protective cover 26. This protective cover also comprises sealed seams 28 which separate the individual straws from one another. The upper edge and the lower edge of the protective cover stripe are each sealed, so that an individual straw is fully sealed from all sides. The straws 4 are oriented in a direction perpendicular to the direction of transportation of the straw stripe 6. A cover tape 8, which is shown in broken line in FIG. 2, is located on the straw stripe. In the perspective view of FIG. 2, this cover tape covers invisible adhesion points on the straw stripe. A section of the back side of a straw stripe, which has positioned thereon the cover tape 8, is shown in FIG. 4. The adhesion points 29 are located between protective cover 26 and cover tape 8 in the area of the straws 4.

Reference numeral 22 designates various deflection rolls for the straw stripe 26 including the cover tape 8. Reference numeral 20 designates deflection rolls for the cover tape after it has been removed from the straw stripe 26. Reference numeral 12 designates a roller having recesses 24 in the manner of a star-shaped wheel which serve as a guide for the straws 4 in the protective cover 26. There may e.g. be provided a suction mechanism which keeps the straws in their position. A knife 14 which is radially movable relative to the star-shaped wheel is provided as a cutting device. In the illustrated embodiment, the pressing device is formed by a finger 16 which is pivotably supported about an axis 19. A pivotal movement of the finger 16, the roller 12, the knife 14 and a pivotal movement of the deflection rolls 20, 22 are effected by the control unit 30 via signal lines and drives, which are not shown. The roller 12 with the recesses 24 may just as well have a larger height than in FIG. 2, so that the straws 4 in the protective cover fully rest in the recesses 24. In such a case corresponding recesses are formed on the circumference of the roller for the pressing means 16.

FIG. 2 specifically shows the second supply means 34. Sheet bag 2*a* has already been provided by the first supply means (not shown) with a straw 4 while sheet bag 2*b* in the second illustrated supply means is provided with a straw, in accordance with arrow 50. The sheet bags which are positioned in a row on the transportation belt 10 in front of the sheet bag 2*a* and behind the sheet bag 2*b* are not shown for the sake of clarity.

The beverage-filled sheet bags 2 are e.g. made of laminated aluminum foil and have inserted bottom surfaces (standing bases) which unfold when being filled, so that the beverage-filled sheet bags 2 become larger in downward direction, thereby offering room for beverages.

The illustrated apparatus operates as follows:

As shown in FIG. 1, filled sheet bags 2 are supplied from a filling and closing system of the straw attaching apparatus, which is not shown in more detail. The transportation belt conveys them to the supply means 32, 34, 36 for straws. The beverage-filled sheet bags 2 are oriented such that the side at which the straw is to be respectively attached faces the supply means. The beverage-filled sheet bags 2 pass through an optical sensor 38 which supplies a signal via the signal line 38*a* to the process computer 30. The speed of the drive 40 of the transportation belt 10 is known to the process computer 30 via the signal line 10*a* or has been determined by the process computer 30. The process computer 30 can thereby determine when a sheet bag 2 passes through the first supply means 32. This supply means 32 is then activated by the process computer 30 such that each first, third and fifth sheet bag 2*a* is provided by the supply means 32 with a straw. The process computer 30 determines on the basis of the speed of the transportation belt 10 and the signal of the sensor 38 when the second, fourth, sixth . . . sheet bag 2*b* passes through the second supply means 34 for supplying straws. The means will then be activated such that the beverage-filled sheet bags which have not been provided by the first supply means 32 with a straw will be provided with a straw. This operation is carried out via signal line 34*a*.

Both the first supply means 32 and the second supply means 34 have a structure as shown in FIG. 2 and FIG. 3, respectively. FIGS. 2 and 3 show how the sheet bags 2 are guided by the transportation belt 10 past the supply means. Whenever a sheet bag which is to be provided with a straw 4 passes through the supply means 32, 34, the control unit 30 supplies a signal to the drive of the finger 16 which will then pivot about the axis 19 and press a straw onto the corresponding beverage-filled sheet bag. The straws 4 are supplied as follows. The straws 4 are part of a straw stripe 6 and are sealed in protective covers 26 which are interconnected on sealed seams 28. The straw stripe 6 runs around various deflection rolls 22 before the withdrawal tape 8 is removed from the adhesion points 29. This tape is discharged by further deflection rolls 20. The straw stripe 6 without the cover tape 8 hits against the star-shaped wheel 12 and is deflected there. The individual protective covers of the straws 4 come to rest in recesses 24. The knife 14 serves to separate the individual protective covers from one another. Thus, when the straws in the protective covers are gripped by the finger 16, they are already isolated. The exposed adhesion points which were covered by the cover tape 8 have the effect that the straws 4 in the protective covers adhere to the beverage-filled sheet bags 2.

For the sake of clarity the figures do not show the means which support the straws or the straw stripe in such a manner that it cannot move upwards or downwards. Such a support mechanism is e.g. formed by clamps which grip the straw stripe from above and release the straws when they are pressed by the finger 16 onto the respective beverage-filled bag 2. These clamps, too, are controlled by the process computer 30 in intermittent fashion.

After the beverage-filled sheet bags have passed through the supply means 32 and 34, each beverage-filled sheet bag 2 should be provided with a straw 4. However, in case one or two of the supply means 32 or 34 fails, e.g. when the straw stripe is torn, sheet bags which have not been provided with a straw are detected by the optical sensor 42. This sensor sends a corresponding signal via the signal line 42*a* to the process computer 30. The computer supplies a corresponding signal to the third supply means 36 via the signal line 36*a* so that at the right time the means attaches a straw to the beverage-filled sheet bag which is devoid of any straws. This third supply means 36 functions in the same manner as described above for the first and second supply means 32 and 34 with reference to FIGS. 2 and 3. In case one of the first or second supply means 32, 34 is inoperative for a long period of time, it is equally ensured that all of the sheet bags 2 are provided with a straw 4.

Hence, the straw attaching apparatus of the invention increases the throughput significantly without any decrease in reliability. In a specific design reliability can be further enhanced if there is provided a third supply means which is used as a substitute for an inoperative first or second supply means.

We claim:

1. A straw attaching apparatus for attaching straws to beverage-filled sheet bags, comprising in combination a transportation means for transporting the beverage-filled sheet bags along a transportation path, a first supply means for supplying a first straw stripe to the beverage-filled sheet bags, said first supply means including a first cutting means for severing said first straw stripe between two respective straws, a first pressing means for respectively pressing a straw onto a beverage-filled sheet bag, a second supply means (34) for supplying a second straw stripe (6) to the beverage-filled sheet bags (2), said second supply means comprising a second cutting means (14) for severing said second straw stripe (6) between two respective straws (4), and a second pressing means (16,19) for respectively pressing a straw (4) onto a beverage-filled sheet bag (2), and a control unit (30) which matches the speeds and operational sequences of said first and second supply means to (32,34) always attach straws (4) to the supplied beverage-filled sheet bags (2*a*) in alternate fashion.

2. The straw attaching apparatus according to claim 1, and a third supply means (36) for supplying a third straw stripe (4) to the beverage-filled sheet bags (2), said third supply means comprising a third cutting means (14) for severing the third straw stripe (6), and a third pressing means (16,19).

3. The straw attaching apparatus according to claim 2, wherein said third supply means (36) is used when said first (32) or said second (34) supply means fails.

4. The straw attaching apparatus according to claim 3, wherein said control unit (30) comprises a means (42) for checking the function of said first (32) and said second (34) supply means and puts into operation said third supply means (36) in response to a signal of said function checking means (42) when said signal is indicative of a malfunction of said first or said second supply means.

5. The straw attaching apparatus according to claims 1 or 2, wherein said respective pressing means are each designed as a finger (16) which is pivotable about an axis (19), said fingers pressing the respective straws (4) with their axially remote end (18) to the beverage-filled bags (2).

6. The straw attaching apparatus according to claim 1 or 2, wherein each said supply means comprises at least two said pressing means (16,19) which engage the straws at different heights.

7. The straw attaching apparatus according to claim 1 or 2, wherein said straw stripes (6) include protective covers (26) for the individual straws (4), the straws (4) in said protective covers (26) being mounted on the sheet bags (2).

8. The straw attaching apparatus according to claim 1 or 2, wherein said supply means (32, 34, 36) comprise clamp means which run along with the respective said straw stripe (6) and comprise clamps which hold the straws (4), said clamp means being activated by said control unit (30) such that they release the straws (4) when the respective said pressing means (16,19) presses the straw (4) against the respective beverage-filled bags (2).

9. The straw attaching apparatus according to claim 1, wherein each respective straw stripe (6) comprises at least one adhesion point (29) per straw (4), said adhesion points being protected by a cover tape (8), and that each said supply means (32, 34, 36) comprises a tape withdrawal means (20) which removes the respective said cover tape (8) from the respective said straw stripe (6) before said stripe is severed by the respective said cutting means (14).

10. The straw attaching apparatus according to claim 9, wherein said cover tape (8) is designed as a carrier tape.

11. The straw attaching apparatus according to claim 1, wherein each respective said straw stripe (6) is supplied via a respective roller (12) to the respective said pressing means (16,19).

12. The straw attaching apparatus according to claim 11 wherein each respective cutting means (14) comprises a radially movable knife relative to the respective said roller (12), the blade of said knife cutting from the outside through the respective straw stripe (6) running around said roller (12).

13. The straw attaching apparatus according to claim 11, wherein said rollers (12) comprise means (24) for guiding the individual straws (4).

14. The straw attaching apparatus according to claim 13, wherein said means (24) for guiding the individual straws (4) include recesses on the circumference of the respective said roller for receiving a respective straw (4).

15. The straw attaching apparatus according to claim 13 or 14, wherein said means for guiding the individual straws (4) are each equipped with a suction mechanism.

16. A method of attaching straws to beverage-filled sheet bags, comprising the steps of transporting the beverage-filled sheet bags along a transportation path, providing each beverage-filled sheet bag with a straw, said beverage-filled sheet bags on their transportation path being alternately provided by a first supply means and a second supply means with a straw.

17. The method according to claim 16, and the further step of, following each first and second supply means, it is detected with the help of a sensor whether the sheet bags have been provided with a straw, and in a negative case, later providing the sheet bags with a straw by a third supply means.

* * * * *